United States Patent [19]

Gugel et al.

[11] Patent Number: 4,552,471

[45] Date of Patent: Nov. 12, 1985

[54] PRINT HEAD WITH PERMANENT MAGNETIC BIAS

[75] Inventors: Bernd Gugel, Ulm-Einsingen; Harald Niebel, Senden, both of Fed. Rep. of Germany

[73] Assignee: Mannesmann AG, Duesseldorf, Fed. Rep. of Germany

[21] Appl. No.: 553,826

[22] Filed: Nov. 21, 1983

[30] Foreign Application Priority Data

Nov. 22, 1982 [DE] Fed. Rep. of Germany ..... 3243477

[51] Int. Cl.[4] ..... B41J 3/12

[52] U.S. Cl. ..... 400/124; 101/93.05

[58] Field of Search ..... 400/124; 101/93.05; 335/229, 232, 235, 236, 304

[56] References Cited

U.S. PATENT DOCUMENTS 4,049,107 9/1977 Murat ..... 400/124

4,401,392 8/1983 Blomquist et al. ..... 400/124

FOREIGN PATENT DOCUMENTS 27365 3/1981 Japan ..... 400/124

*Primary Examiner*—Paul T. Sewell

*Attorney, Agent, or Firm*—Ralf H. Siegemund

[57] ABSTRACT

A print head includes a coil carrier having upwardly bent legs serving as yokes and being arranged around or upon a permanent magnet whose outer face is coplanar with the end faces of the yokes; a cover plate is mounted on and in that plane having apertures adjacent the space between the permanent magnet and the closest yoke. A set of armature plates is resiliently mounted on the other side of the cover plate respectively adjacent the apertures which are filled with nonmagnetizable material, and the magnet plate of each armature has affixed to it thin, side-wall type members converging towards a main apex-point to which the stylus is mounted.

9 Claims, 2 Drawing Figures

PRINT HEAD WITH PERMANENT MAGNETIC BIAS

BACKGROUND OF THE INVENTION

The present invention relates to a print head for matrix printers or the like using a carrier for the actuating coils which operate styli for purposes of providing the imprint of individual dots out of which a character to be printed will be composed. A coil carrier of the type to which the invention pertains is provided with magnetic yokes arranged around the circumference of the carrier as a whole whereby each yoke is associated with an electromagnetic actuating coil as well as with an armature which operates directly the respective stylus; the armature abuts the rear end of the stylus and the front end of the latter provides the imprint; selective application of current to the coil followed by suitable retraction operation causes the respective stylus to reciprocate. In particular the invention relates to a print head of the type in which the armature retraction is provided through the operation of a permanent magnet which affects the magnetization of the respective electromagnetic actuating circuit such that there is a reversal of forces whenever current does not flow through the respective coils.

Print heads of the type to which the invention pertains have in the past been used in an environment equivalent to slow, line printers providing roughly 600 characters per second. However, such print heads are considerably less expensive than the comparable line printers as far as print speed is concerned. On the other hand, it was found that the life of such print heads measured in millions of characters printed is lower than a conventional line printer. Therefore, current development tends to improve print heads for matrix printers towards a greater life while, of course, trying to retain the economic advantage over line printers. In this regard it is to be considered that a print head for matrix printers is an object which has a particular mass which reciprocates across the platen. Therefore, the head has to be accelerated from a speed value of zero up to a constant speed of propagation across the platen and at the end it has to be stopped for purposes of reversal. This rather significant exertion of force and the effects of inertia are instrumental in reducing the life of such a head. It is also apparent that these problems are the more pronounced the heavier such a head is constructed.

The German printed patent application No. 30 40 399 proposes a high speed dot-matrix printer generally of the type outlined above and operating on a continuous basis at a speed of 800 characters per second. The head used in that printer is supposedly economical and is definitely lighter because the construction is such that about only one-third as many parts are used as in other known print heads. Moreover, this known printer is particularly constructed with regard to the respective magnetic circuits in that the pole faces of the pole shoes are arranged in planes which are arranged in right angles to each other and the several pole faces are placed in close proximity such that the armature is provided with surfaces respectively running parallel to these pole faces. Moreover, a pair of intersecting, bending members is provided for the formation of a pivot bearing for any of the armatures and the pivot axis is situated at least approximately in the plane of the pole face of the electromagnet. This way a motion is forcedly imparted upon the armature to run along a track which intersects the plane of the pole face of the respective electromagnet so that the permanent magnet included in the circuit holds the armature in abutment with the pole surface of the electromagnet and at a small distance from the pole shoe associated with the respective permanent magnet.

The magnetic system as described in this prior art publication is undoubtedly endowed with certain advantages. However, it includes more air gaps in the magnetic circuit as is desired. Moreover, the construction of each of the several components involved is quite extensive and expensive; reference is made here particularly to the construction involving intersecting or crossed bending members for purposes of establishing a particular kind of pivot bearing for the armature.

DESCRIPTION OF THE INVENTION

It is an object of the present invention to provide a new and improved print head for operating elongated styli such as print needles or wires, the construction is to be such that higher speeds can be permitted, manufacturing techniques improved towards simplification and a higher electrical degree of efficiency can be obtained.

In accordance with the preferred embodiment of the present invention it is suggested to provide basically a coil carrier, i.e. a carrier for the electromagnetic actuating coils for the print styli, which coil carrier has along its outer periphery a plurality of upwardly extending, magnetic yokes, comparable in number with the number of styli to be operated. These yokes establish a space in the interior of which is provided a flat disk shaped permanent magnet at such a geometry that the outer surface of the electromagnet is coplanar with the ends of the legs of the magnetic yokes. A cover plate is situated in that plane and is made of magnetizable material but has an aperture in a location in between the legs or yokes and the permanent magnet and is filled with nonmagnetizable material. A armature construction is chosen being comprised basically of a plate element in each instance which faces this aperture filled with nonmagnetizable material and being mounted on a spring that tends to urge the armature plate away from the magnetic assembly; the mechanical bias is overcome by the flux obtained through the permanent magnet as long as the respective coil circumscribing the respective yoke is not energized. The armature in each instance is completed through an extension at the end of which is mounted the respective styli in the preferred form. The extension is made of thin metal constituting in overall elevational configuration, a triangle, at one apex of which is mounted the stylus, and the armature itself is the base of that triangle.

It was found that this particular construction enhances utilization of the available magnetic flux which in one instance, of course, is provided by the permanent magnet while the respective electromagnet modifies the existing flux up to a point that the magnetic attraction towards respective armature is overcome. The overall construction features expounded above are quite simple and the various elements are simple to assemble under overal low-weight considerations.

The improved utilization of the available magnetic flux is particularly obtained through the configuration of the cover with a local interruption and deflection of the magnetic flux namely by the aperture filled with nonmagnetizable material. This aperture and the nonmagnetizable material is, of course, primarily provided for deflecting the flux into the respectively abutting magnetic plate of the respective armature but in overall configuration it turns out that the stray flux exhibited is extremely low. Instrumental here is further that the plate of the respective armature covers, in fact, the respective aperture and is in direct, magnetic, conductive relation with the surrounding material of the cover plate.

Utilization of biased spring element for mounting the armature permits simple adjustment during assembly whereby particularly bending bias is instrumental in avoiding unequal propulsion for the several styli.

As far as the coil carrier is concerned, the yokes are preferably constructed as U's with unequally long legs whereby the short legs is that part which directly extends from the respective central portion of the coil carrier on which the permanent magnet is mounted. In the case of an annular arrangement one produces therefore a pot-like coil carrier in the interior of which is mounted the permanent magnet. In the case of a regular matrix printer, the overall assembly is an annular one, i.e. the several yoke legs extend circularly around the common center. Alternatively, the legs can be provided in two rows for accommodating a linear arrangement of needles, styli, hammers or the like. In the former case, the permanent magnet will be round or disk-shaped; in the latter case it will be bar-shaped.

Particular advantages result from assembly features such as establishing modular units. For example, the resilient element of the side walls or extensions from the armature plate and the needle or print stylus, forms one module. Another module particularly for obtaining low weight and stray flux minimization is to be considered by arranging the coil carrier, the permanent magnet and the disk shaped cover in directly abutting aereal contact relationship and they, in turn, constitute another unit.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 2:
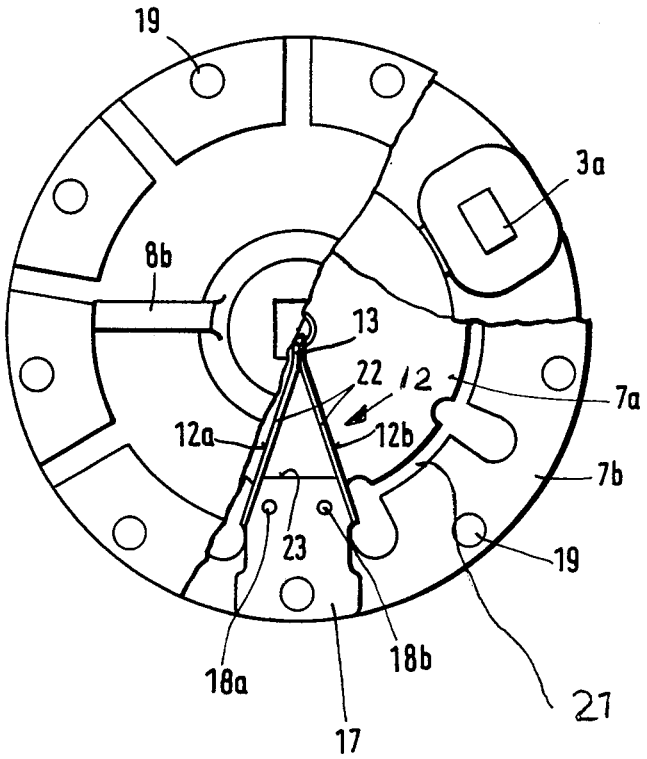
FIG. 2 is a top elevation of the print head shown in FIG. 1 with several parts being shown in a peeled-away fashion.

Proceeding now to the detailed description of the drawings, the Figures show a coil carrier 1 having an outer periphery 2 which is generally constructed to form and establish peripherally arranged magnetic yokes or yoke arms 3. Therefore, the coil carrier 1 is generally of a shell or trough-like construction. The carrier itself is made of soft iron, by means of drawing and press working as well as punching. The trough circumscribes an interior space 1*a*. The magnetic yoke leg 3 are basically of rectangular construction and cross section as can be seen best from FIG. 2. These legs extend in upward direction as seen generally along the axis of the system 16. Each of these yoke legs 3 is provided to be circumscribed, i.e. to be received by a electromagnetic coil such as 4. Each leg has the profile of a U with unequal legs. The short legs 3*a* extend from the center of the carrier.

The interior space of the coil carrier is in part occupied by a permanent magnet 5 resting on the center of carrier 1. The yoke legs 3 have front end faces 3*b*, and in the preferred mode of construction the front face 5*a* of the permanent magnet 5 as well as faces 3*b* occupy a common plane 6. This geometric relation may, for example, be provided by adjusting the thickness or position of the permanent magnet 5 in relation to the common front faces 3*b* of the yoke legs 3.

A magnetizable cover 7 is provided in the plane 6 and together with the magnet 5 as well as with a coil carrier 1 and a rear portion 8*a* of the housing of the print head, these parts are interconnected in order to establish a unit or module. These parts are held together by means of a centrally disposed screw or bolt 9. The screw or bolt 9 is magnetically separated from the permanent magnet 5 and from the coil carrier 1 by means of the magnetically insulating sleeve 10.

The cover 7 is shown in this example to be composed of two pieces, i.e. an inner plate 7*a* and an outer annulus 7*b* defining in between them a space 21. This space 21 is filled with nonmagnetizable material such as melting solder, casting resin, an adhesive, a ceramic material or the like. The gap 21 guides and directs the magnetic flux in precisely predeterminable paths without entailing detrimental stray fluxes.

Figure 1:
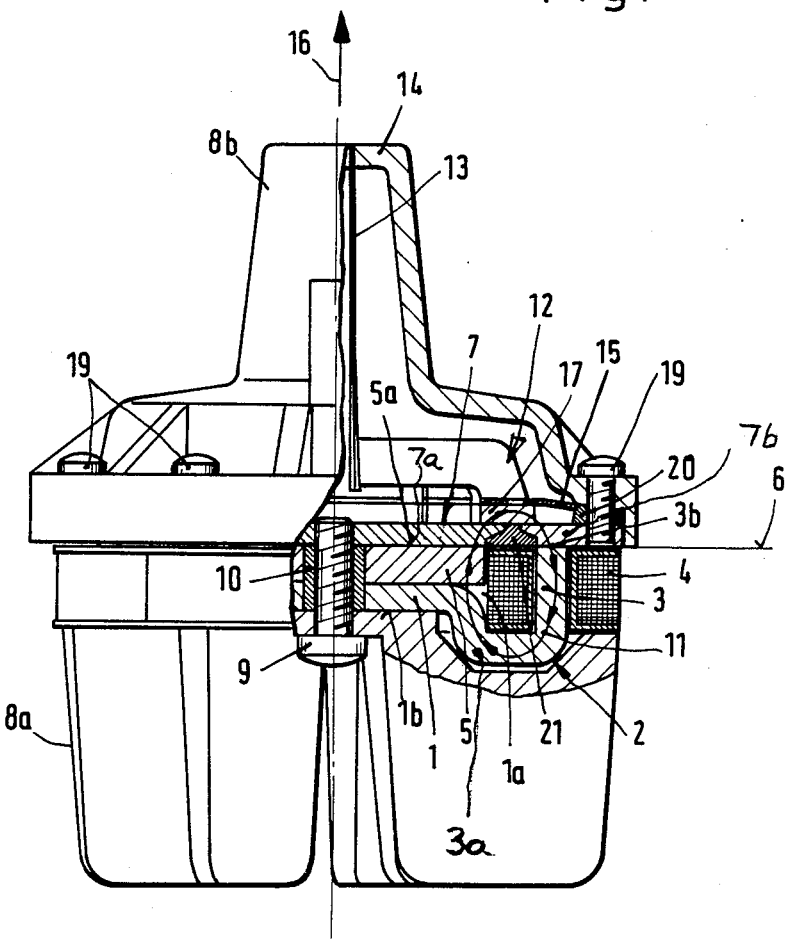
FIG. 1 is a side elevational view of a print head constructed in accordance with the preferred embodiment of the present invention for practising the best mode thereof, the print head being shown partially in an open section view.

In view of this particular arrangement of the permanent magnet a magnetic flux 11 is set up around each electromagnetic coil, provided current does not flow through the coil. As a consequence the armature 12 is provided and shifted into a position as illustrated in FIG. 1. A print needle wire or stylus 13 has its rear end affixed or connected to the pivotting portion of one of the armatures 12. All of these print styli are run towards a mouthpiece 14 of the front part 8*b* of the casing. The armatures 12 themselves are fastened to resilient elements 15. In each of the illustrated instances the respective resilient or spring element 15 is in the illustrated position provided current does not flow through the respective coil.

On the basis of the foregoing overall description it can readily be seen that upon initiating current flow through the magnetic coil the magnetic field of the permanent magnet 5 within the electromagnetic circuit is rapidly compensated so that the mechanical force of the resilient element 15 causes the mass of the armature 12 as well as the mass of the stylus or needle 13 to be propelled forward in the direction 16 towards the recording or printing medium. The printing medium such as paper is not illustrated and the platen arrangement, etc., is quite conventional.

Each armature 12 is constructed to have light thin side wall members 12*a* and 12*b* connected to a magnetic plate 17. The resilient element 15 in turn is connected to the plate 17 from which these side walls 12*a* and 12*b* extend, by means of bolts 18*a* and 18*b*. The resilient element 15 has a free end and rests with that end in lever-like fashion upon the cover 7 by means of fastening screws 19 and a matching, spacing and adapting piece 20.

The coil carrier 1 is made by means of shape punching followed by bending under utilization of sheet or plate stock. The coil carrier 1 is therefore basically to be considered a economically manufacturable and lightweight base element or body 1*a*. The yoke legs 3*a* are bent off below the bottom surface 1*a* of the carrier 1 and returned upwardly to resemble in cross section a U with unequally long legs whereby, of course, the long outer legs extend well above the bottom surface 1*b* of the coil carrier.

It should be noted that the invention and the embodiments that can be constructed on the basis of the inventive principle are not limited to an annular arrangement of print needles 13. One can equally arrange the needles or styli in long parallel row, and the yoke legs are correspondingly arranged in such parallel rows. In other words, the annular arrangement with upwardly bent legs is easily adaptible in principle to a trough-like configuration wherein the legs extend in two rows along a trough-like cavity.

The side walls 12*a* and 12*b* of the armatures, the respective print needle or stylus 13 associated with the armature to which these side walls pertain, and the respective resilient element 15 likewise pertaining to that armature assembly are interconnected to form a structural unit, the interconnection may be effected by means of screws or welding or soldering. Moreover, the side wall pieces 12*a* and 12*b* are made of a sheet stock having a thickness such that a bending, stiff, cross section 22 is established while in overall configuration the arrangement is triangular as can be seen particularly in FIG. 2. A triangle is established in each instance by most portions of each of the side walls 12*a* and 12*b* and by the end phase 23 of the base plate 17.

Another constructural unit or module is established by means of the coil carrier 1, the permanent magnet 5 and the disk-shaped cover 7 which are placed flat one upon the other and thereby establish a compact unit.

The invention is not limited to the embodiments described above, but all changes and modifications thereof, not constituting departures from the spirit and scope of the invention are intended to be included.

We claim:

1. In a print head for operating and containing elongated styli, the combination comprising a coil carrier having along its periphery upwardly bent yoke legs in integral configuration, each having a front end face, all the front end faces being situated in a common plane;

a permanent magnet arranged centrally on the coil carrier and having an outer surface being coplanar with said front end faces of said yoke legs;

a magnetizable cover plate arranged in abutment with said faces in a plane defined by said coplanarity;

said magnetizable cover plate having aperture means adjacent the respective armatures for interrupting the magnetic flux, the apertures being filled with a nonmagnetizable material;

a plurality of coils respectively arranged around said yoke legs underneath said cover plate; and a plurality of armatures resiliently mounted on top of said cover plate and having a first portion juxtaposed to said coils and a second portion for respectively carrying a print stylus.

2. In a printhead as in claim 1, said nonmagnetizable material being synthetic resin.

3. In a print head as in claim 1, said nonmagnetizable material being melting solder.

4. In a print head as in claim 1 wherein each of the armature is connected to a resilient element there being means for tension biasing the respective resilient element.

5. In a print head as in claim 1 wherein in cross section each of said yokes extends from a central portion of the carrier at a contour of a U with unequally long legs.

6. In a print head as in claim 1 wherein said armature in each instance is comprised of the magnetizable plate from which extend thin side walls in an overall triangularly shaped elevation, said stylus being affixed to one of the corners of the triangle facing away from said magnetizable plate.

7. In a print head as in claim 6 wherein said resilient bias is obtained through a resilient element urging the magnetizable plate away from said cover plate, said permanent magnet attracting the magnet plate of each armature against the cover plate, energization of the coil eliminates said magnetic bias.

8. In a printhead as in claim 1, said nonmagnetizable material being a ceramic material.

9. In a printhead as in claim 1, said nonmagnetizable material being an adhesive.

* * * * *